US005817004A

United States Patent [19]

Koch

[11] Patent Number: 5,817,004

[45] Date of Patent: Oct. 6, 1998

[54] THERMOTHERAPY DEVICE FOR INFANTS

[75] Inventor: Jochim Koch, Ratzeburg, Germany

[73] Assignee: Drägerwerk AG, Lübeck, Germany

[21] Appl. No.: 933,470

[22] Filed: Sep. 18, 1997

[30] Foreign Application Priority Data

May 9, 1997 [DE] Germany ..... 197 19 533.4

[51] Int. Cl.[6] ..... A61G 11/00

[52] U.S. Cl. ..... 600/22; 600/21

[58] Field of Search ..... 600/21–22; 292/DIG. 17; 160/DIG. 8; 128/201.12; 312/1

[56] References Cited

U.S. PATENT DOCUMENTS

| | | | |
|---|---|---|---|
| 4,191,174 | 3/1980 | Martin | 600/22 |
| 4,788,965 | 12/1988 | Milani et al. | 600/22 |
| 5,316,733 | 5/1994 | Rune et al. | 600/22 X |

FOREIGN PATENT DOCUMENTS 0 237 941 B1 3/1987 European Pat. Off. .

*Primary Examiner*—Jennifer Bahr
*Assistant Examiner*—Michael Astorino
*Attorney, Agent, or Firm*—McGlew and Tuttle

[57] ABSTRACT

A thermotherapy device with a hood (4), two flaps (6, 7) pivotable around hinges (5) for closing longitudinally extending, essentially triangular access opening portions in the hood. The opening has an essentially horizontally extending base edge (15). First access areas (12, 13) with the greatest width are directed to the outside, and second access areas (14), which are arranged opposite the first access areas (12, 13), face each other. Objects can be introduced into the interior space of the incubator with both hands simultaneously, without the climate within the hood (4) being compromised in an unacceptable manner. This is achieved by the access openings being designed as areas passing over into each other in the area of the second access areas (14), as a result of which a contiguous access opening (8) is formed in the hood (4).

3 Claims, 1 Drawing Sheet

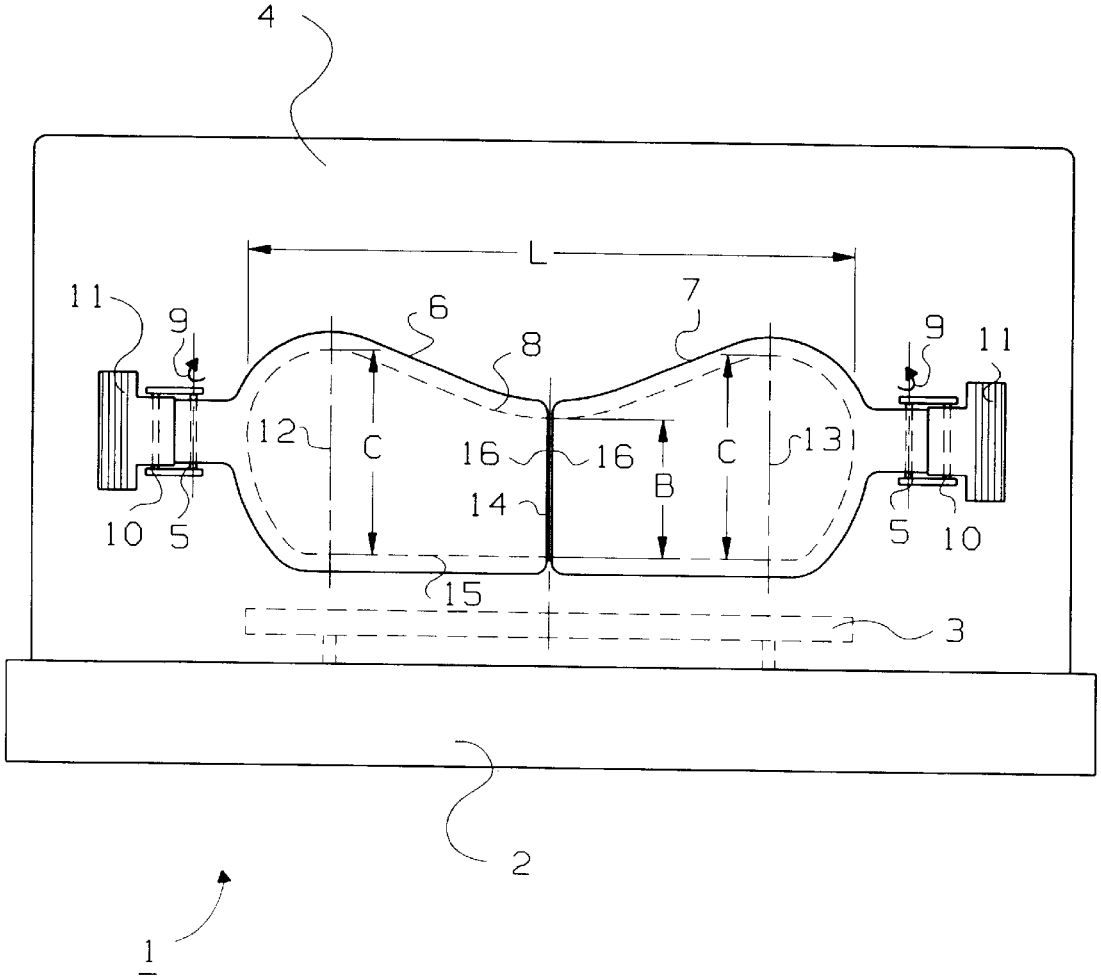
4
L
11
9
6
8
7
9
11
12
C
16
16
B
C
13
14
10
5
5
10
15
3
2
1

THERMOTHERAPY DEVICE FOR INFANTS

FIELD OF THE INVENTION

The present invention pertains to a thermotherapy device for infants with a hood, two flaps pivotable around hinges for closing longitudinally extending, essentially triangular access openings in the hood, which have an, essentially horizontally extending base edge, and whose first access areas with the greatest width are directed to the outside, and whose second access areas arranged opposite the first access areas face each other.

BACKGROUND OF THE INVENTION

Various designs of thermotherapy devices for infants have been known. For example, there is a support surface for the infant on a lower part of an incubator, and the interior space of the incubator is closed by a transparent hood. The atmosphere in the interior space, which is specified with respect to certain conditions, such as temperature, oxygen content and humidity, remains closed against the surrounding room. To perform treatment and care procedures, access openings are arranged in pairs in the hood, but these access openings shall release a relatively small open area only even in the opened state because it is necessary to maintain the atmosphere of the interior space. The requirement to have a small open area of the access openings conflicts with the need to obtain a sufficient free space for the movement of the hands and arms reaching in and good accessibility to all essential areas of the interior space.

An incubator with a transparent hood and two access openings, which are designed as rounded triangles and can be closed by a flap pivotable around a hinge, has become known from EP 0 237 941 B1. The access openings have a common, essentially horizontally extending base edge and form an obtuse angle between their longitudinal axes. The flaps closing the access openings also consist of a transparent material, wherein the hinges and the closing elements are arranged in the closed position on the same flap sides with the greatest width. Vision is hindered only slightly as a result, and the closing elements for the operator standing in front of the incubator are thus also on the ergonomically correct side.

The drawback of the prior-art incubator is that only limited access is possible to the patient through the separately arranged access openings. Thus, it is difficult, e.g., to introduce an object, e.g., a suction catheter, into the interior space of the incubator with both hands together. The suction catheter must first be pulled through one of the access openings with one hand, and it is taken over by the second hand in the interior space. The suction catheter must not touch the limiting surface of the access opening for hygienic reasons.

SUMMARY AND OBJECTS OF THE INVENTION

The primary object of the present invention is to improve a thermotherapy device of the above-described type such that objects can be introduced into the interior of the hood with both hands, without the climate within the hood being compromised in an unacceptable manner.

According to the invention, a thermotherapy device for infants is provided with a hood, two flaps pivotable around hinges for closing longitudinally extending, essentially triangular access openings in the hood. The access openings have an essentially horizontally extending base edge. The access openings have first access areas, with the greatest width, directed to the outside, and second access areas arranged opposite the first access areas, which face each other. The access openings are designed as areas passing over into each other (a unitary access opening) in the area of the second access areas, as a result of which a contiguous access opening is formed in the hood.

The advantage of the present invention is essentially that the freedom of movement of the arms is improved due to the missing partition between the access openings, and adverse effects on the climate within the hood are minimized due to the shape of the access opening tapering toward the center. Due to the design of the access openings proposed according to the present invention, which pass over into each other, an elongated access opening is formed, which becomes larger toward the outside and through which both hands can be passed. The geometry of the access opening proposed according to the present invention arises from the spatial ergonomics of the movement of the arms when an operator standing in front of the incubator is standing with his body in parallel to the hood of the incubator. Fictitious section surfaces are obtained in this position between the position of the arms and the hood. The freedom of movement of the arms with the supporting bed in an oblique position is also taken into account by the selected contour for the access opening.

The two flaps, which close the access opening, may have different designs. As an alternative to the pivoting around a vertical axis, rotation of the flaps around a horizontal axis is also possible, and the flaps can be opened both upward and downward in the case of the horizontal pivoting of the flaps.

The second access area of the access opening is advantageously arranged in the middle, on the narrowest side, with a width between 100 mm and 120 mm. Ergonomic studies have revealed that this width is sufficient, e.g., for introducing suction catheters into the interior space of the incubator without difficulties.

The flaps in the second access area preferably have a limiting edge forming essentially the same angle with the base edge. It is especially advantageous for the limiting edge to be designed such that it is at right angles to the base edge. An especially good closing of the access opening with the flaps can thus be achieved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

In the drawings:

The only FIGURE is a schematic view of an incubator according to the invention.

DESCRIPTION OF THE PREFERRED EMBODIMENT

Referring to the drawing in particular, the only FIGURE schematically shows an incubator 1, which comprises a lower part 2 with a support bed 3 for accommodating an infant, not shown in the FIGURE, and a transparent hood 4. The hood 4 has two flaps 6, 7, which can be pivoted around hinges 5 and close an access opening 8. The access opening 8 is indicated by broken line in the FIGURE. The flaps 6, 7 can be locked in the closed position by means of two rocker arms 11 that can be actuated around vertical pivot axes. The flaps 6, 7 are pivoted in the direction of the arrows 9 during the opening process.

The access opening 8 has two first access areas 12, 13, which point toward the outside of the hood 4 and at which the access opening 8 has its greatest width C, and a second access area 14 with the smallest width B in the middle. A base edge 15 of the access opening 8 extends essentially horizontally, i.e., in parallel to the lower part 2. The maximum longitudinal extension L of the access opening 8 is 480 mm, the width B in the second access area 14 is 110 mm, and the width C of the second access areas 12, 13 is 150 mm. At their contact point, the flaps 6, 7 have limiting edges 16, which extend perpendicularly to the base edge 15.

While a specific embodiment of the invention has been shown and described in detail to illustrate the application of the principles of the invention, it will be understood that the invention may be embodied otherwise without departing from such principles.

What is claimed is:

1. A incubator for infants, comprising:

a hood with a longitudinally extending access opening the blood including hinges two flaps pivotable around said hinges for closing said hood opening, said opening having an essentially horizontally extending base edge, said opening having first access areas with a greatest width toward an outside of said opening, said opening having second access areas arranged between said first access areas, said second access areas merging into each other to provide a contiguous access opening.

2. The incubator in accordance with claim 1, wherein said second access areas have a width of 100 mm to 120 mm.

3. The incubator in accordance with claim 1, wherein said flaps in a region of said second access areas have a limiting edge forming essentially the same angle with said base edge.

* * * * *